US008464548B2

(12) United States Patent
Okuda et al.

(10) Patent No.: US 8,464,548 B2
(45) Date of Patent: Jun. 18, 2013

(54) AIR CONDITIONER

(75) Inventors: Noriyuki Okuda, Osaka (JP); Norihiro Takenaka, Osaka (JP); Tomohiro Masui, Osaka (JP)

(73) Assignee: Daikin Industries, Ltd., Osaka (JP)

( * ) Notice: Subject to any disclaimer, the term of this patent is extended or adjusted under 35 U.S.C. 154(b) by 312 days.

(21) Appl. No.: 12/997,156

(22) PCT Filed: Jun. 4, 2009

(86) PCT No.: PCT/JP2009/002528
§ 371 (c)(1),
(2), (4) Date: Dec. 9, 2010

(87) PCT Pub. No.: WO2009/150804
PCT Pub. Date: Dec. 17, 2009

(65) Prior Publication Data

US 2011/0079033 A1 Apr. 7, 2011

(30) Foreign Application Priority Data

Jun. 12, 2008 (JP) ..... 2008-153970

(51) Int. Cl.
*F25D 23/12* (2006.01)

(52) U.S. Cl.
USPC ..... 62/259.2; 62/498

(58) Field of Classification Search
USPC ..... 62/259.2, 184, 498, 156, 52.1; 165/80.3, 165/104.33, 104.21; 361/715, 743
See application file for complete search history.

(56) References Cited

U.S. PATENT DOCUMENTS

| | | | | |
|---|---|---|---|---|
| 5,365,749 | A * | 11/1994 | Porter | 62/259.2 |
| 5,574,627 | A * | 11/1996 | Porter | 361/719 |
| 6,054,676 | A * | 4/2000 | Wall et al. | 219/209 |
| 6,125,036 | A * | 9/2000 | Kang et al. | 361/700 |
| 6,243,268 | B1 * | 6/2001 | Kang et al. | 361/715 |
| 6,526,768 | B2 * | 3/2003 | Wall et al. | 62/184 |
| 6,527,686 | B1 * | 3/2003 | Houser et al. | 483/1 |
| 6,644,048 | B2 * | 11/2003 | Goth et al. | 62/158 |
| 6,698,218 | B2 * | 3/2004 | Goth et al. | 62/175 |
| 7,242,581 | B2 * | 7/2007 | Minamitani et al. | 361/699 |
| 7,254,024 | B2 * | 8/2007 | Salmon | 361/699 |
| 7,308,802 | B2 * | 12/2007 | Liu et al. | 62/259.2 |
| 7,394,149 | B2 * | 7/2008 | Clayton et al. | 257/686 |
| 8,198,539 | B2 * | 6/2012 | Otoshi et al. | 174/252 |
| 8,250,877 | B2 * | 8/2012 | Correa et al. | 62/259.2 |

FOREIGN PATENT DOCUMENTS

| | | | |
|---|---|---|---|
| CN | 101111719 | A | 1/2008 |
| CN | 101118081 | A | 2/2008 |
| EP | 1862743 | A1 | 12/2007 |
| JP | 62-69066 | A | 3/1987 |
| JP | 5-66028 | A | 3/1993 |
| JP | 2006-214633 | A | 8/2006 |
| JP | 2008-70016 | A | 3/2008 |

* cited by examiner

*Primary Examiner* — Mohammad M Ali
(74) *Attorney, Agent, or Firm* — Birch, Stewart, Kolasch & Birch, LLP

(57) ABSTRACT

A printed-circuit board (31) having a power element (33) and a refrigerant jacket (20) to which the power element (33) is thermally connected, with refrigerant circulating therein used in refrigeration cycle, are provided in an outdoor unit casing (70). The printed-circuit board (31) is provided in a switch box (40). A face of the outdoor unit casing (70) has a service opening (71). The refrigerant jacket (20) faces the service opening (71), being closer to the front side of the outdoor unit casing (70) than the power element (33) as viewed from the service opening (71).

3 Claims, 6 Drawing Sheets

AIR CONDITIONER

TECHNICAL FIELD

The present invention relates to air conditioners which provide a vapor compression refrigeration cycle with refrigerant circulating therein.

BACKGROUND ART

There is provided an electric circuit such as an inverter circuit in air conditioners which provide a vapor compression refrigeration cycle with refrigerant circulating therein. Such an inverter circuit controls a motor of a compressor. In the inverter circuit, a power element which generates high heat is commonly employed. Conventional air conditioners include a cooling means configured to cool the power element, to prevent the temperature of the power element from exceeding the operable temperature range thereof. Examples of the cooling means include a cooling means configured to cool the power element by the refrigerant used in refrigeration cycle (for example, see Patent Document 1). As described in Patent Document 1, in an air conditioner, a refrigerant jacket has a refrigerant passageway (heatsink in Patent Document 1) through which the refrigerant used in refrigeration cycle flows. A power element (giant transistor in Patent Document 1) is fixed to the refrigerant jacket, and the refrigerant jacket is included in a switch box (electric component box).

CITATION LIST

Patent Document

PATENT DOCUMENT 1: Japanese Patent Publication No. S62-69066

SUMMARY OF THE INVENTION

Technical Problem

Since air conditioners commonly have a compressor in the outdoor unit, the switch boxes are often provided also in the outdoor unit. In this case, in order for the switch box to be fixed to the outdoor unit, for example, first, a refrigerant pipe is placed in the outdoor unit, together with a refrigerant jacket. Then, the switch box is inserted through an opening provided in the casing of the outdoor unit, so that the refrigerant jacket and the power element are thermally connected by securing them to each other by screws. Such a structure is convenient at the time of manufacturing, repair, or the like.

However, if any gap is left between the refrigerant jacket and the power element when they are thermally connected, heat is exchanged inefficiently between the refrigerant jacket and the power element, thereby producing a cooling effect smaller than expected.

In view of the above, it is an object of the present invention to provide a tight fit between a refrigerant jacket and a power element at the time of manufacturing, repair or the like.

Solution to the Problem

Therefore, a first aspect of the present invention is an air conditioner which includes: a printed-circuit board (31) having a power element (33); and a refrigerant jacket (20) to which the power element (33) is thermally connected, with refrigerant circulating therein used in refrigeration cycle. The printed-circuit board (31) and the refrigerant jacket (20) are included in a casing (70) of an outdoor unit (100). The refrigerant circulating in the refrigerant jacket (20) cools the power element (33).

A face of the casing (70) has a service opening (71).

The refrigerant jacket (20) faces the service opening (71), and is closer to the front side of the casing (70) than the power element (33) as viewed from the service opening (71).

This enables the connection between the refrigerant jacket and the power element to be identified visually through the service opening (71) at the time of manufacturing, repair or the like.

In a second aspect of the present invention, in the air conditioner according to the first aspect, the casing (70) includes an assembly opening (72) in a face next to the face having the service opening (71). The board (31) is inserted through the assembly opening (72).

This enables the printed-circuit board (31) to be inserted through the assembly opening (72) included in a face next to the face having the service opening (71) when the air conditioner is manufactured or repaired. Since the assembly opening (72) is included in the face next to the face having the service opening (71), the printed-circuit board (31) is inserted behind the refrigerant jacket (20) when the printed-circuit board (31) is fixed to the outdoor unit, without letting the printed-circuit board (31) go over the refrigerant jacket (20).

In a third aspect of the present invention, in the air conditioner of the first aspect, the printed-circuit board (31) is placed in a longitudinal position so that the power element (33) is in an upper half of the printed-circuit board (31).

As a result, since the power element (33) is placed at a position upper than the other elements on the printed-circuit board (31), the heat dissipated into air from the power element (33) is conducted upward by airflow. Therefore, conducting the heat dissipated into air from the power element (33) to other circuit elements becomes more difficult because of air.

Advantages of the Invention

According to the first aspect of the present invention, the connection between the refrigerant jacket and the power element can be identified visually through the service opening (71) at the time of manufacturing, repair or the like. Therefore, the refrigerant jacket and the power element are connected properly, so that a desired cooling effect can be obtained.

According to the second aspect of the present invention, the printed-circuit board (31) is inserted behind the refrigerant jacket (20), without letting the printed-circuit board (31) go over the refrigerant jacket (20). Therefore, the printed-circuit board (31) can be easily fixed to the outdoor unit.

According to the third aspect of the present invention, the thermal influence of the power element (33) on the other elements provided on the printed-circuit board (31) can be reduced.

DESCRIPTION OF EMBODIMENTS

Figure 1:
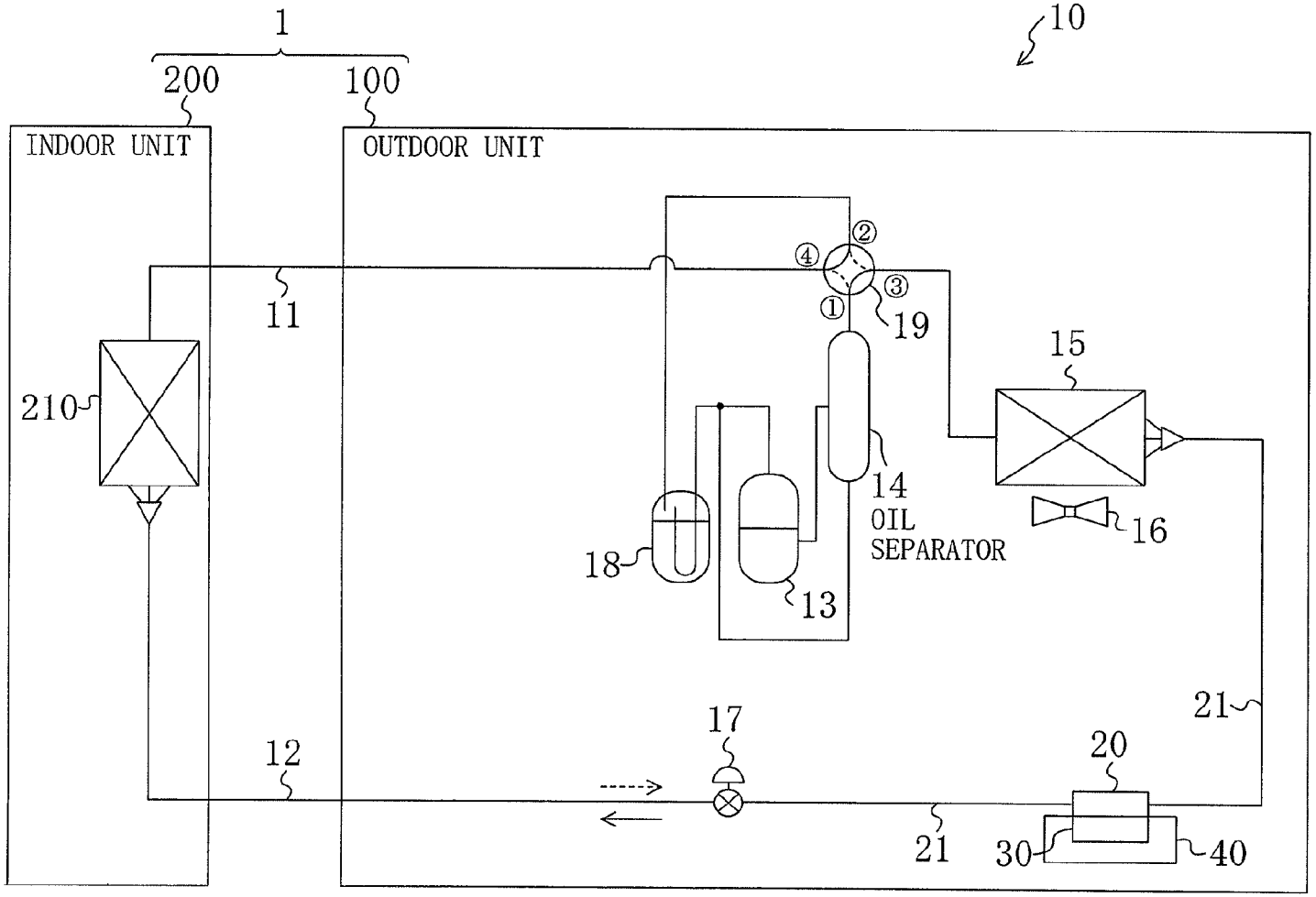
FIG. 1 is a piping system diagram illustrating a refrigerant circuit (10) of an air conditioner (1) according to a first embodiment of the present invention.

Hereinafter, embodiments of the present invention will be described specifically with reference to the drawings. The following embodiments are merely preferred examples in nature, and are not intended to limit the scope, applications, and use of the invention. In the following embodiments, the similar structural members are given the same reference characters as those in any of the preceding embodiments, and their detailed descriptions are omitted.

Embodiment 1

FIG. 1 is a piping system diagram illustrating a refrigerant circuit (10) of an air conditioner (1) according to a first embodiment of the present invention. The air conditioner (1) is a heat-pump type air conditioner for performing both cooling and heating operations. As shown in FIG. 1, the air conditioner (1) includes: an outdoor unit (100) provided outside a room; and an indoor unit (200) provided inside the room. The outdoor unit (100) and the indoor unit (200) are connected to each other through a first connection pipe (11) and a second connection pipe (12), thereby constituting a refrigerant circuit (10) which provides a vapor compression refrigeration cycle, with refrigerant circulating therein.

<Indoor Unit>

The indoor unit (200) includes an indoor heat exchanger (210) for transferring heat between refrigerant and outdoor air. Examples of the indoor heat exchanger (210) include a cross-fin-type fin-and-tube heat exchanger. An indoor fan (not shown) is provided near the indoor heat exchanger (210).

<Outdoor Unit>

The outdoor unit (100) includes a compressor (13), an oil separator (14), an outdoor heat exchanger (15), an outdoor fan (16), an expansion valve (17), an accumulator (18), a four-way valve (19), a refrigerant jacket (20), and an electric circuit (30). These components are included in a case (outdoor unit casing (70) to be described later).

The compressor (13) sucks in refrigerant through a suction port, compresses the refrigerant, and then discharges the compressed refrigerant through a discharge port. Various examples of the compressor (13) include a scroll compressor.

The oil separator (14) separates the refrigerant mixed with lubricating oil discharged from the compressor (13), into refrigerant and lubricating oil. Then, the oil separator (14) transfers the refrigerant to a four-way valve (19), and returns the lubricating oil to the compressor (13).

The outdoor heat exchanger (15) is an air heat exchanger for transferring heat between refrigerant and outdoor air. Examples of the outdoor heat exchanger (15) include a cross-fin-type fin-and-tube heat exchanger. An outdoor fan (16) is provided near the outdoor heat exchanger (15) so that outdoor air is transferred to the outdoor heat exchanger (15).

The expansion valve (17) is connected to the outdoor heat exchanger (15) and to the indoor heat exchanger (210). The expansion valve (17) expands the refrigerant which has flown thereinto, reduces the pressure thereof to a predetermined pressure value, and then let the refrigerant flow out. Examples of the expansion valve (17) include a motor-operated expansion valve which changes the degree of the opening thereof.

The accumulator (18) separates the refrigerant which has flown thereinto, into gas and liquid, and transfers the separated gas refrigerant to the compressor (13).

The four-way valve (19) has four ports of the first to fourth. The four-way valve (19) is switchable between a first position (position indicated by the solid lines in FIG. 1) in which the first port communicates with the third port and at the same time, in which the second port communicates with the fourth port, and a second position (position indicated by the broken lines in FIG. 1) in which the first port communicates with the fourth port and at the same time, in which the second port communicates with the third port. In the outdoor unit (100), the first port is connected to the discharge port of the compressor (13) through the oil separator (14), and the second port is connected to the suction port of the compressor (13) through the accumulator (18), respectively. The third port is connected to the second connection pipe (12) through the outdoor heat exchanger (15) and the expansion valve (17), and the fourth port is connected to the first connection pipe (11), respectively. In the outdoor unit (100), the four-way valve (19) is switched to the first position in cooling operation, and to the second position in heating operation.

Figure 2:
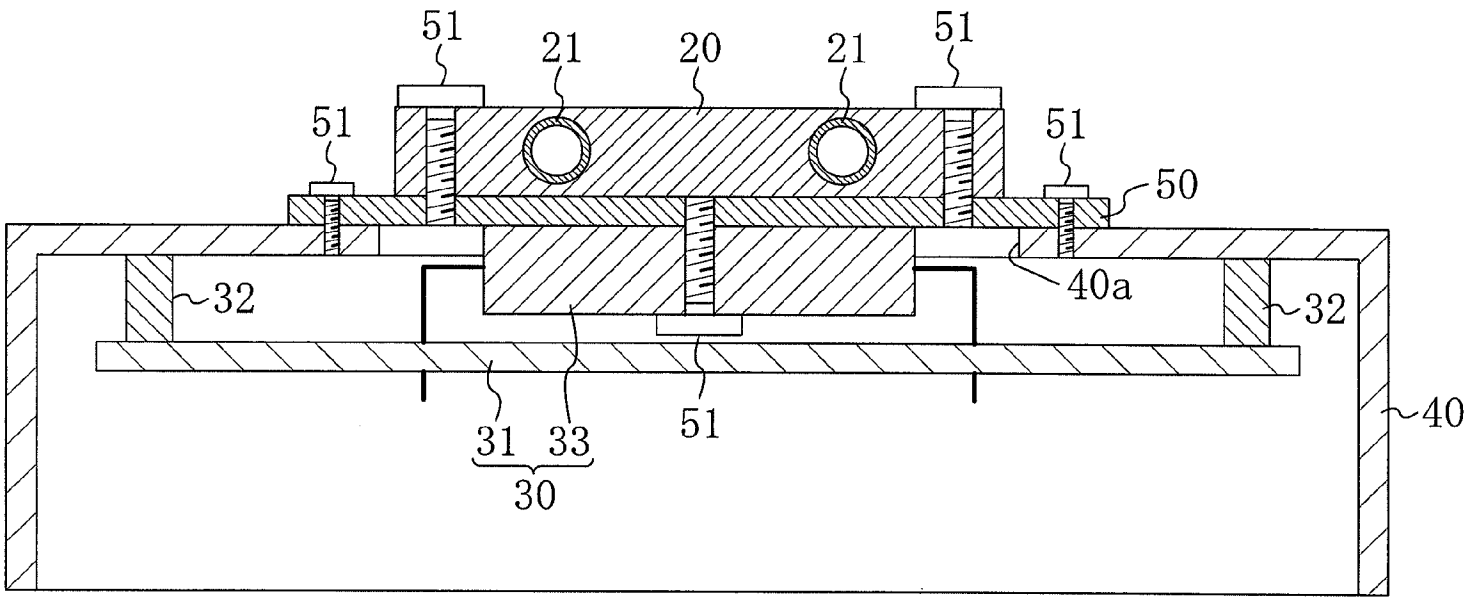
FIG. 2 illustrates an assembly structure as to how a power element (33), a refrigerant jacket (20), and a heat transfer plate (50) are assembled.

Examples of the refrigerant jacket (20) include a generally flat rectangular solid made of metal such as aluminum, etc. The refrigerant jacket (20) partially covers a refrigerant pipe (21) which connects the outdoor heat exchanger (15) with the expansion valve (17). The refrigerant jacket (20) is thermally connected to the refrigerant pipe (21). Specifically, as shown in FIG. 2, the refrigerant jacket (20) has two through-holes through which the refrigerant pipe (21) is fitted into. The refrigerant pipe (21) runs through one through-hole, makes a U-turn, and then runs through the other through-hole. Specifically, the refrigerant jacket (20) is regarded as having the refrigerant used in refrigeration cycle, circulating therein.

The electric circuit (30) controls the revolution speed of a motor of the compressor (13). The electric circuit (30) is provided on a printed-circuit board (31). The printed-circuit board (31) is fixed in a switch box (40) by spacers (32). As shown in FIG. 2, components including a power element (33) are arranged on the printed-circuit board (31). The power element (33) is a switching element of an inverter circuit for supplying power to the motor of the compressor (13). The power element (33) produces heat while the compressor (13) is operating. Without cooling the power element (33), the temperature of the power element (33) can possibly exceeding the operable temperature range thereof (for example, 90° C.). Therefore, in the air conditioner (1), the refrigerant circulating in the refrigerant jacket (20) cools the power element (33).

Specifically, in the air conditioner (1), as shown in FIG. 2, the refrigerant jacket (20) is fixed to the switch box (40) so that the power element (33) in the switch box (40) is cooled. More specifically, the switch box (40) has a generally box shape. The switch box (40) has an opening in one face thereof. The face opposed to the opening has a through-hole (40*a*). To the switch box (40), a heat transfer plate (50) having a generally plate shape is fixed with assembly screws (51) so that the heat transfer plate (50) covers the through-hole (40*a*). The heat transfer plate (50) is made of a material having a relatively small thermal resistance such as aluminum, etc.

To the heat transfer plate (50), the refrigerant jacket (20) is secured with assembly screws (51) from outside the switch box (40), and the power element (33) is secured with an assembly screw (51) from inside the switch box (40). In this structure, the heat of the power element (33) is conducted to the refrigerant jacket (20) through the heat transfer plate (50), and then dissipated into the refrigerant circulating the refrigerant jacket (20).

Specifically, the outdoor heat exchanger (15) condenses refrigerant so that the refrigerant flows through the refrigerant jacket (20) at a temperature lower than that of the power element (33) in cooling operation. In heating operation, the indoor heat exchanger (210) condenses refrigerant so that the refrigerant flows there the refrigerant jacket (20) at a temperature lower than that of the power element (33). In these cases, the temperature of the refrigerant flowing through the refrigerant jacket (20) is approximately 40 to 45° C. in cooling operation, although the temperature varies according to operating conditions, outdoor air conditions, and the like. Therefore, the heat generated in the power element (33) of the electric circuit (30) is conducted to the refrigerant jacket (20) through the heat transfer plate (50), and then dissipated into the refrigerant in the refrigerant pipe (21) of the refrigerant jacket (20). This enables the power element (33) to be held within the operable temperature range thereof.

Figure 3:
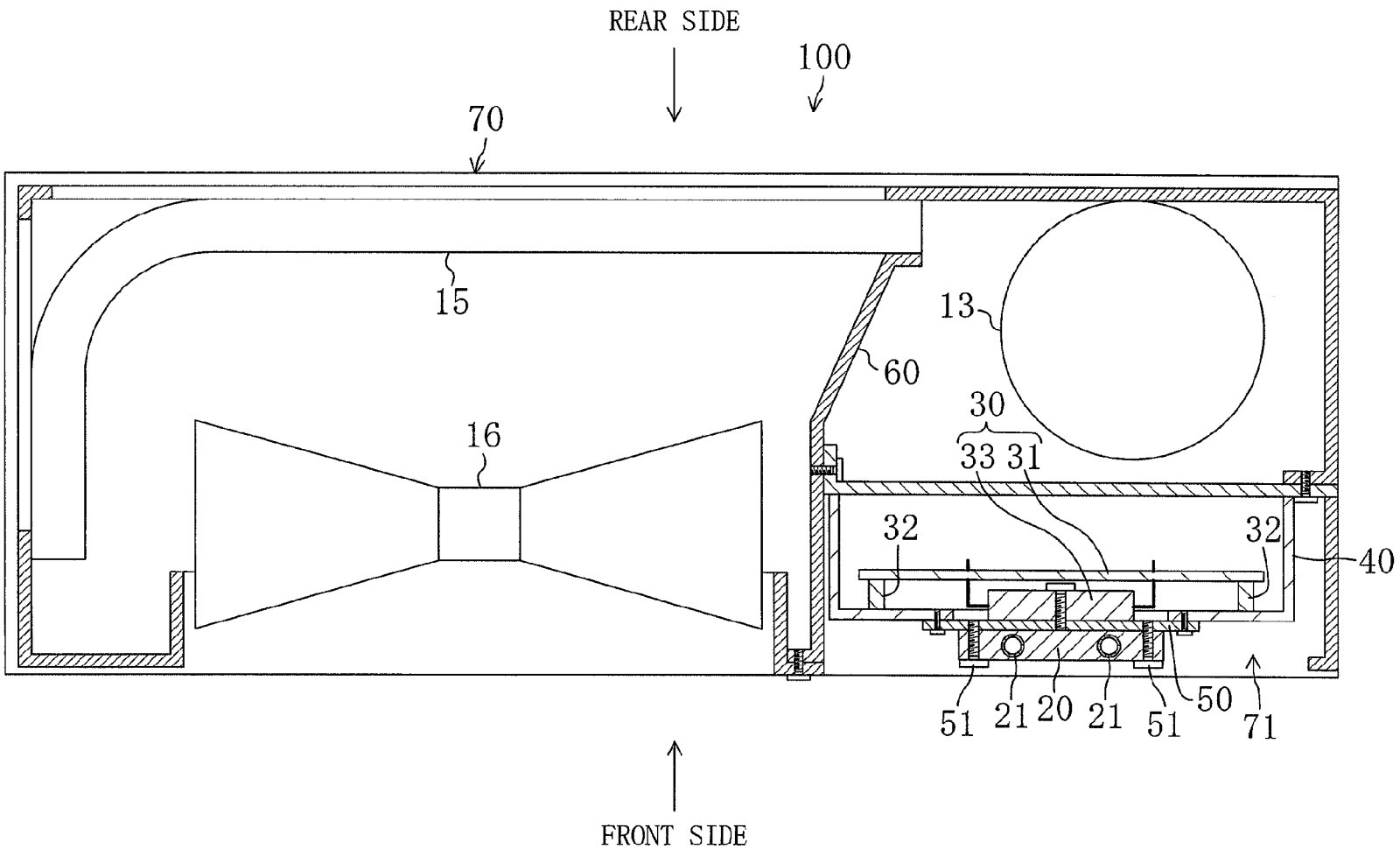
FIG. 3 schematically shows a transverse cross-section of the outdoor unit (100), illustrating a layout of major components such as a compressor (13).

FIG. 3 schematically shows a transverse cross-section of the outdoor unit (100), illustrating a layout of major components such as the compressor (13). As shown in FIG. 3, the outdoor unit casing (70) is divided into two by a divider (60). In one division (heat exchange room), the outdoor heat exchanger (15) having an L-shaped cross-section is placed to face both a side face and a rear face of the outdoor unit casing (70). The outdoor fan (16) is placed near the outdoor heat exchanger (15). In the other division (machine room), the refrigerant jacket (20), the compressor (13), the switch box (40), and the like are placed. Specifically, the outdoor unit casing (70) has the service opening (71) to the machine room in the front face thereof. The side of the switch box (40) on which the heat transfer plate (50) is provided, is closer to the front side as viewed from the service opening (71). The refrigerant jacket (20) is closer to the front side than the heat transfer plate (50) (specifically, than the power element (33)), as viewed from the service opening (71).

Fixing of Switch Box (40) to Outdoor Unit Casing (70)

In this embodiment, the printed-circuit board (31) and the heat transfer plate (50) are fixed to the switch box (40) in advance. Specifically, first, the heat transfer plate (50) is fixed to the switch box (40) with the assembly screws (51). The printed-circuit board (31) is then put in the switch box (40) in this state, and fixed to the switch box (40) through the spacers (32). The power element (33) is also fixed to the heat transfer plate (50) with the assembly screw (51) for thermal connection. The switch box (40) thus assembled is inserted into the outdoor unit casing (70) through the service opening (71), when the air conditioner (1) is manufactured, when the printed-circuit board (31) is re-fixed for repair, or the like.

Figure 4:
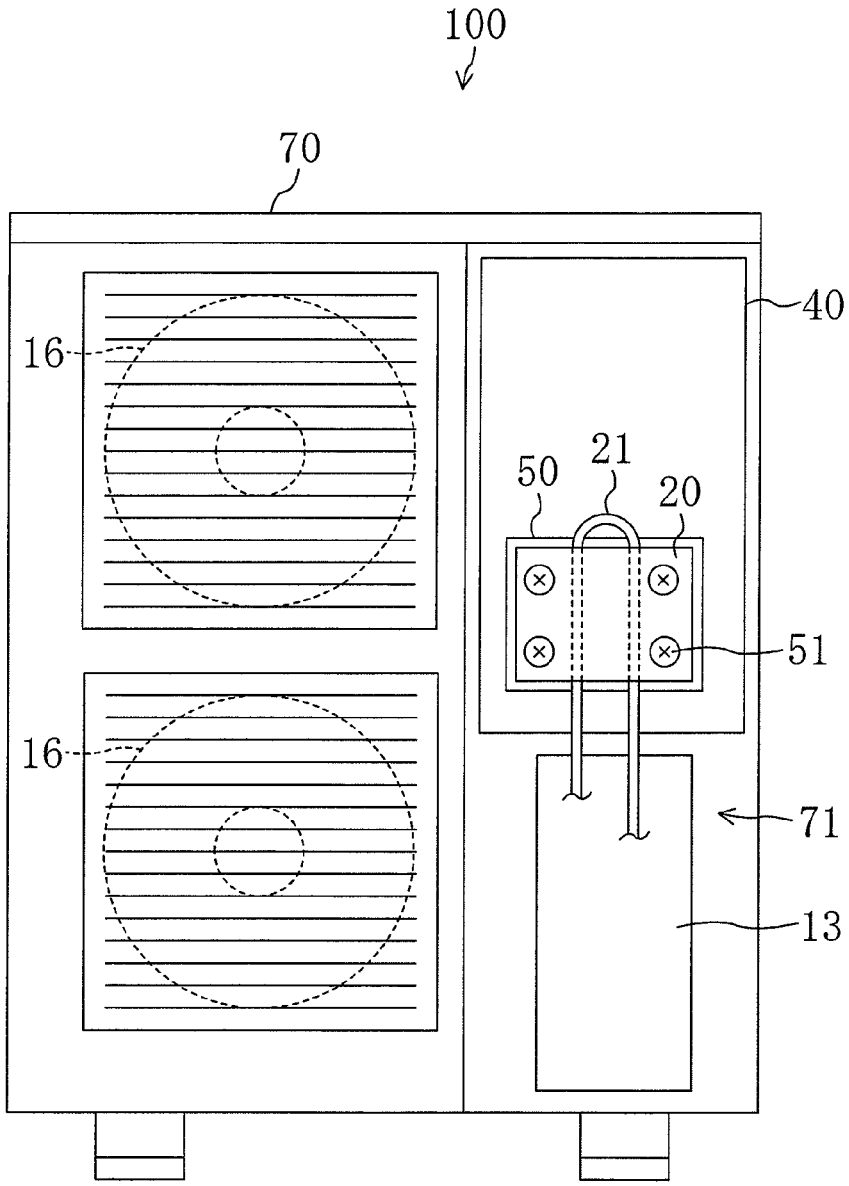
FIG. 4 is a front view of an outdoor unit (100).

FIG. 4 is a front view of the outdoor unit (100). In this case, the outdoor unit casing (70) has space large enough for the switch box (40) to pass through the space above the refrigerant jacket (20). The space is accessible through the service opening (71). The switch box (40) is fixed to the outdoor unit casing (70) through the service opening (71). In this case, the switch box (40) goes over the refrigerant jacket (20) so that the switch box (40) is closer to the rear side than the refrigerant jacket (20). When the switch box (40) goes over the refrigerant jacket (20), the switch box (40) is in a position in which the heat transfer plate (50) is closer to the front side (specifically, in which the side of the heat transfer plate (50) to face the refrigerant jacket (20) is closer to the front side). In this position, the refrigerant jacket (20) and the heat transfer plate (50) are fixed to each other with the assembly screws (51).

In this case, if any gap is left between the refrigerant jacket (20) and the heat transfer plate (50), heat is exchanged inefficiently between the refrigerant jacket (20) and the power element (33), thereby producing a cooling effect smaller than expected. In this embodiment, since the refrigerant jacket (20) is closer to the front side than the power element (33) as viewed from the service opening (71), the connection between the refrigerant jacket (20) and the heat transfer plate (50) can be identified visually when the refrigerant jacket (20) and the heat transfer plate (50) are fixed to each other with the assembly screws (51). Therefore, in this embodiment, the refrigerant jacket (20) and the power element (33) are connected properly at the time of manufacturing, repair or the like, so that a desired cooling effect can be obtained.

Embodiment 2

Figure 5:
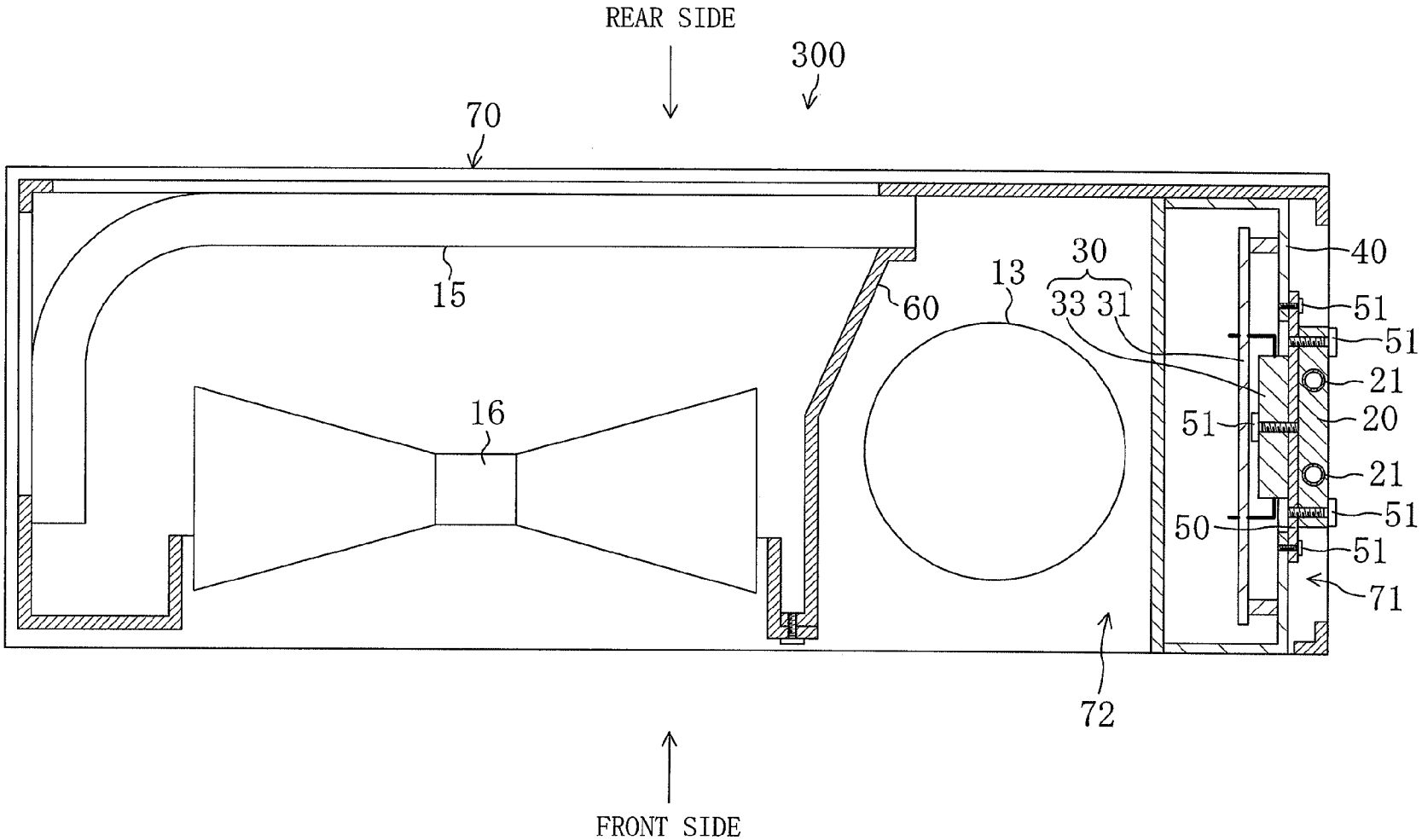
FIG. 5 schematically shows a transverse cross-section of an outdoor unit (300) according to a second embodiment of the present invention.

FIG. 5 schematically shows a transverse cross-section of an outdoor unit (300) according to a second embodiment of the present invention. As shown in FIG. 5, in the outdoor unit (300), a switch box (40) is fixed to a position different from that in the outdoor unit (100) according to the first embodiment.

In this embodiment, as shown in FIG. 5, the outdoor unit casing (70) includes a service opening (71) in a side face. Near the service opening (71), a refrigerant jacket (20) is provided. In a face next to the face having the service opening (71) (in the front face of the outdoor unit casing (70) in this example), an assembly opening (72) is provided. The assembly opening (72) has a size large enough for the switch box (40) to pass therethrough. The space behind the refrigerant jacket (20) (closer to the rear side of the outdoor unit casing (70)) is accessible through the assembly opening (72).

This structure enables the switch box (40) (specifically, printed-circuit board (31)) to be inserted behind the refrigerant jacket (20), without letting the switch box (40) go over the refrigerant jacket (20) as in the first embodiment. Specifically, the switch box (40) (specifically, printed-circuit board (31)) can be easily placed.

Embodiment 3

Figure 6:
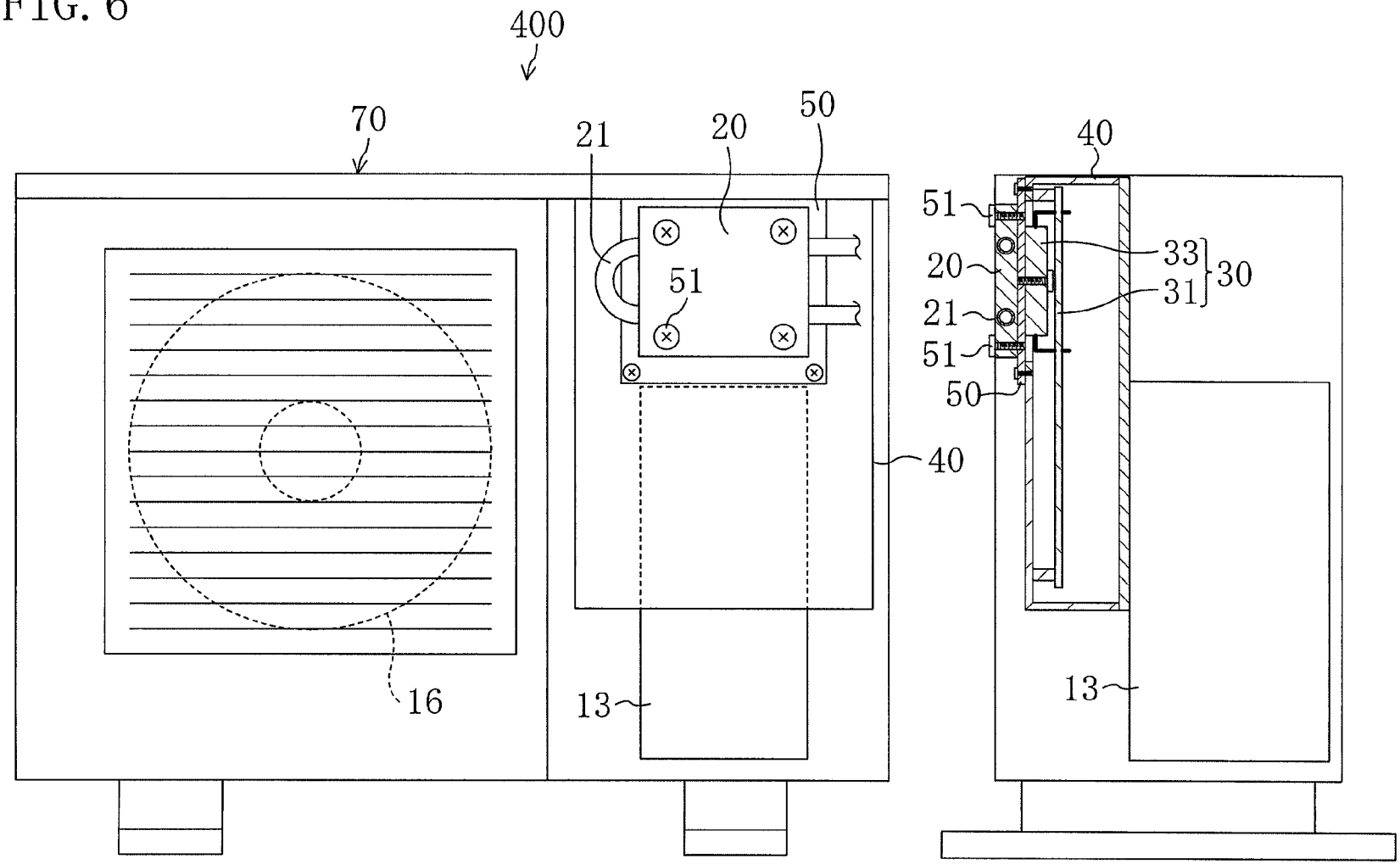
FIG. 6 shows a front view and a schematic side cross-sectional view of an outdoor unit (400) according a third embodiment of the present invention.

FIG. 6 shows a front view and a schematic side cross-sectional view of an outdoor unit (400) according a third embodiment of the present invention. The outdoor unit (400) according to this embodiment is characterized as to how to fix a printed-circuit board thereto. Specifically, in this embodiment, as shown in FIG. 6, the printed-circuit board (31) is placed in a longitudinal position so that the power element (33) is in an upper part of the printed-circuit board (31).

As a result, the heat dissipated into air from the power element (33) is conducted upward by airflow. Therefore, the outdoor unit (400) can reduce transfer of the heat dissipated into air from the power element (33) to other circuit elements through air, thereby reducing the thermal influence of the power element (33) on the other elements provided on the printed-circuit board (31).

INDUSTRIAL APPLICABILITY

The present invention is useful for air conditioners which provide a vapor compression refrigeration cycle, with refrigerant circulating therein.

DESCRIPTION OF REFERENCE CHARACTERS

1 air conditioner
20 refrigerant jacket

31 printed-circuit board
33 power element
70 outdoor unit casing (casing)
71 service opening
72 assembly opening
100, 300, 400 outdoor unit

The invention claimed is:

1. An air conditioner comprising:

a printed-circuit board (31) having a power element (33); and a refrigerant jacket (20) to which the power element (33) is thermally connected, with refrigerant circulating in the refrigerant jacket (20), the refrigerant used in refrigeration cycle, wherein the printed-circuit board (31) and the refrigerant jacket (20) are provided in a casing (70) of an outdoor unit (100), the refrigerant circulating in the refrigerant jacket (20) cools the power element (33), the casing (70) has a face having a service opening (71), and the refrigerant jacket (20) faces the service opening (71), being closer to a front side of the casing (70) than the power element (33) as viewed from the service opening (71).

2. The air conditioner of claim 1, wherein the casing (70) has an assembly opening (72) in a face next to the face having the service opening (71) through which the printed-circuit board (31) is inserted.

3. The air conditioner of claim 1, wherein the printed-circuit board (31) is placed in a longitudinal position so that the power element (33) is in an upper part of the printed-circuit board (31) when the casing (70) is installed.

* * * * *